US006186190B1

(12) United States Patent
Verclyte

(10) Patent No.: US 6,186,190 B1
(45) Date of Patent: Feb. 13, 2001

(54) SELVAGE INSERTION APPARATUS FOR A WEAVING MACHINE

(75) Inventor: Eddy Verclyte, Ypres (BE)

(73) Assignee: Picanol, N.V., Ypres (BE)

( * ) Notice: Under 35 U.S.C. 154(b), the term of this patent shall be extended for 0 days.

(21) Appl. No.: 09/319,272

(22) PCT Filed: Dec. 17, 1997

(86) PCT No.: PCT/EP97/07085

§ 371 Date: Aug. 9, 1999

§ 102(e) Date: Aug. 9, 1999

(87) PCT Pub. No.: WO98/28474

PCT Pub. Date: Jul. 2, 1998

(30) Foreign Application Priority Data

Dec. 20, 1996 (BE) ..... 9601072

(51) Int. Cl.[7] ..... D03D 47/48

(52) U.S. Cl. ..... 139/434; 139/1 R

(58) Field of Search ..... 139/434, 1 R, 139/430, 54

(56) References Cited

U.S. PATENT DOCUMENTS 5,158,119 * 10/1992 Pezzoli et al. ..... 139/434
5,431,195 * 7/1995 Corain et al. ..... 139/434
6,009,917 * 1/2000 Meyns et al. ..... 139/54

* cited by examiner

*Primary Examiner*—Andy Falik
(74) *Attorney, Agent, or Firm*—Bacon & Thomas, PLLC

(57) ABSTRACT

A selvage insertion apparatus (13) for a weaving machine with at least one insertion arm (18) and at least one filling thread clamp (17) which can be applied through a drive device to control a filling thread and which operate from a common drive shaft (40). An individual drive motor (61) is operated by a programmable control system (14) and powers the drive shaft (40).

16 Claims, 5 Drawing Sheets

SELVAGE INSERTION APPARATUS FOR A WEAVING MACHINE

BACKGROUND OF THE INVENTION

1. Field of the Invention

The invention relates to selvage insertion apparatus for a weaving machine, with at least one insertion arm and at least one thread clamp which have a drive device to control a weft thread and which operate from a common drive shaft.

2. Description of the Related Art

With regard to known selvage insertion apparatus of the above-mentioned type U.S. Pat. Nos. 4,905,740; 4,909,283 and 4,957,145; European patent A 0,626,476), the power for the drive shaft is taken from a weaving machine's main shaft. Accordingly the selvage insertion apparatus operates synchronously with the weaving machine's main shaft and runs according to this main shaft's speed.

Furthermore U.S. Pat. No. 5,158,119 discloses selvage insertion apparatus including an insertion arm, a thread clamp and a thread cutter each with its own drive motor. The insertion arm is axially displaceable by one motor and rotatable by another motor. The thread clamp and the thread scissors each are axially displaceable by their own motors. This selvage insertion apparatus is operated by a microprocessor that controls the individual motors. This microprocessor also receives data concerning the weaving machine's weaving cycle. Position sensors are combined with the insertion arm and immediately detect operational malfunction, whereupon the microprocessor shuts down the motors to prevent collision between the insertion arm and/or the thread clamp and the scissors and the reed.

SUMMARY OF THE INVENTION

The objective of the invention is to provide a selvage insertion apparatus of the above type that improves selvage formation.

This problem is solved by providing a particular drive motor for the drive shaft and providing this motor with a programmable control system.

The invention is based on the recognition that the weaving machine's main shaft does not rotate at constant speed. This is because the main shaft reciprocally drives weaving machine components such as a batten and shed-formers. Furthermore, the varying speed of the main shaft also depends on the pattern of the warp threads according to which the shed formers are raised and lowered to form consecutive sheds from a specific number of warp threads that are moved up and down. In accordance with the invention, the drive motor of the selvage insertion apparatus is operated by its own programmable control system, and therefore its position and in particular, the speed of its insertion arm, can be selected in such manner that the ends of the filling treads can all be inserted in an identical manner. This feature is made possible because the insertion arm is moved into and out of the warp threads always at a predetermined time and with predetermined speed, and consequently, the ends of the filling threads are always accurately laid into a subsequent shed, thereby improving the fabric quality. This is possible because the predetermined speed of the insertion arm is independent of the speed fluctuations of the weaving machine's main shaft.

In one embodiment of the invention, the control system includes a device that controls the speed of the selvage insertion device drive motor during the insertion of the ends of filling threads according to the control programs of the control system. As a consequence, the selvage insertion arm may remain (dwell) as long as needed between the warp threads which is advantageous for good selvaging.

In another embodiment of the invention, retrievable programs to run the drive motors are stored in the control system and are designed for different kinds of filling threads and/or weave patterns. Consequently, the operation of the drive motor and hence in particular the position and the speed of the insertion arm are easily adapted to the particular filling threads that are processed and/or to the particular weave pattern(s) used.

In yet another embodiment of the invention, the control system contains a device for comparing reed motion with the motions of the insertion arm and the thread clamp, and changes the drive-motoroperation to avoid collisions between the devices. In this manner, malfunctions or defective adjustments can be avoided that might otherwise cause the reed to hit the insertion arm or the thread clamp with ensuing damage to the reed elements.

BRIEF DESCRIPTION OF THE DRAWINGS

The following description of the illustrative embodiments shown in the drawings describes further features and advantages of the invention.

DETAILED DESCRIPTION OF THE PREFERRED EMBODIMENTS OF THE INVENTION

Figure 1:
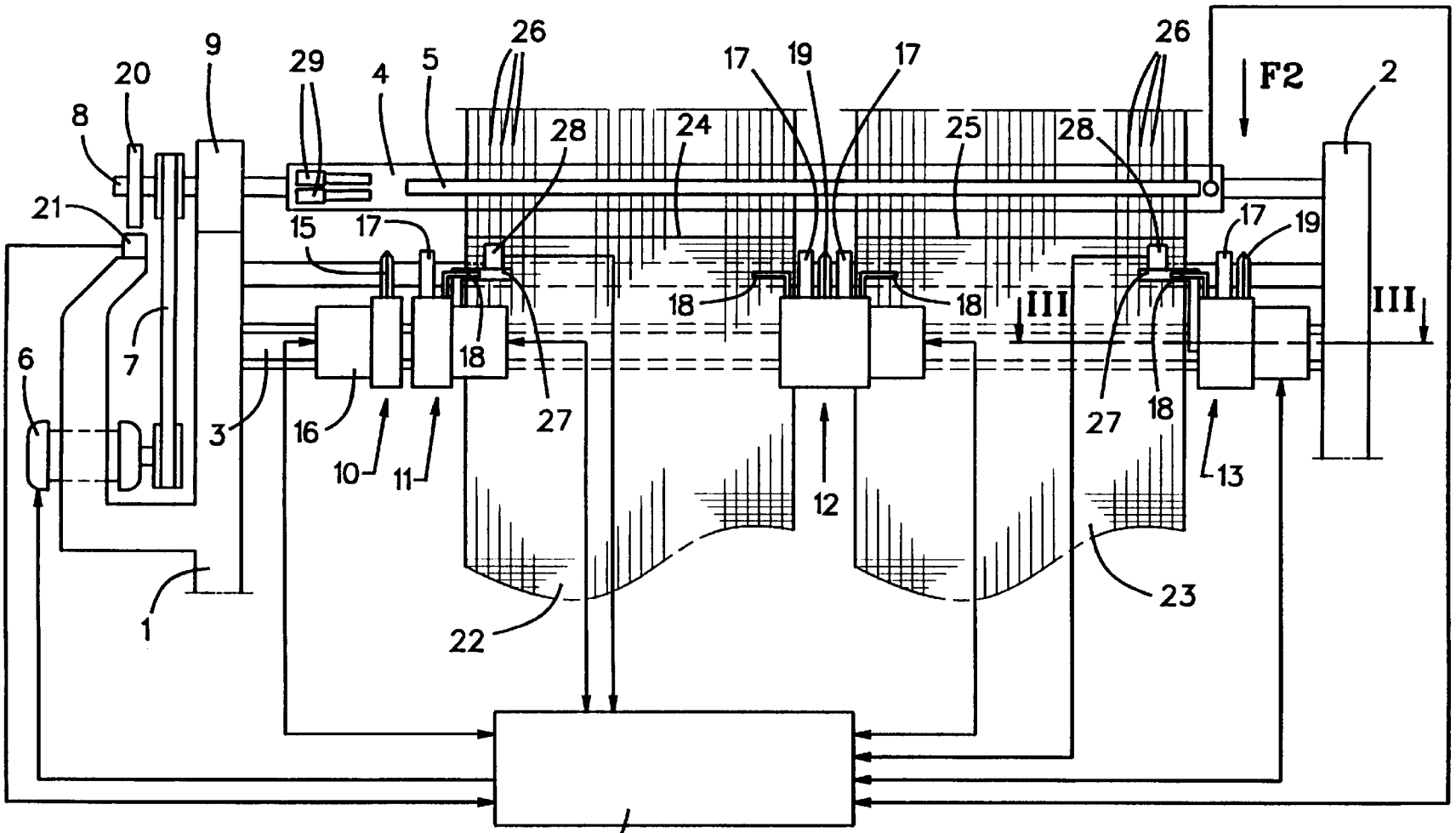
FIG. 1 diagrammatically shows part of a weaving machine provided with several insertion devices of the invention.

The portion of a weaving machine shown in FIG. 1 includes two side frames 1 and 2 spanned by a crossbar 3; a batten 4 with a reed 5; a drive motor 6, connected by a transmission 7 including two belt pulleys and one belt connected to a drive 9 for the weaving machine's main shaft 8 operating the batten 4; a filling thread cutter 10; several selvage insertion devices 11, 12, 13; and a control system 14. The filling thread cutter 10 comprises filling thread scissors 15 provided with scissor blades and a drive unit 16. Selvage insertion apparatus 11 includes a thread clamp 17 and an insertion arm 18. Selvage insertion apparatus 12 contains two thread clamps 17, two insertion arms 18 and filling thread scissors 19 with scissor blades mounted between the two thread clamps 17. Selvage insertion apparatus 13 contains one thread clamp 17, one insertion arm 18 and filling thread scissors 19 provided with scissor blades.

An encoding disk 20 is mounted on the weaving machine's main shaft 8 and a sensor 21 transmits signals of the angular position of the encoding disk 20 and hence, the position of the main shaft 8 to the control system 14. FIG. 1 also shows two fabrics 22 and 23 with their selvages 24 and 25 and warp threads 26. An expander 27 with a proximity sensor 28 is associated with the selvages of fabrics 22, 23 facing the side frames 1 or 2. The proximity sensors 28 respond to the position of reed 5 and generate a corresponding signal. This embodiment shows an airjet weaving machine provided with two main jet nozzles 29 mounted on the batten 4. The cutter 10, the selvage insertion apparatus 11, 12,13 and the expanders 27 are mounted on the crossbar 3.

Figure 2:
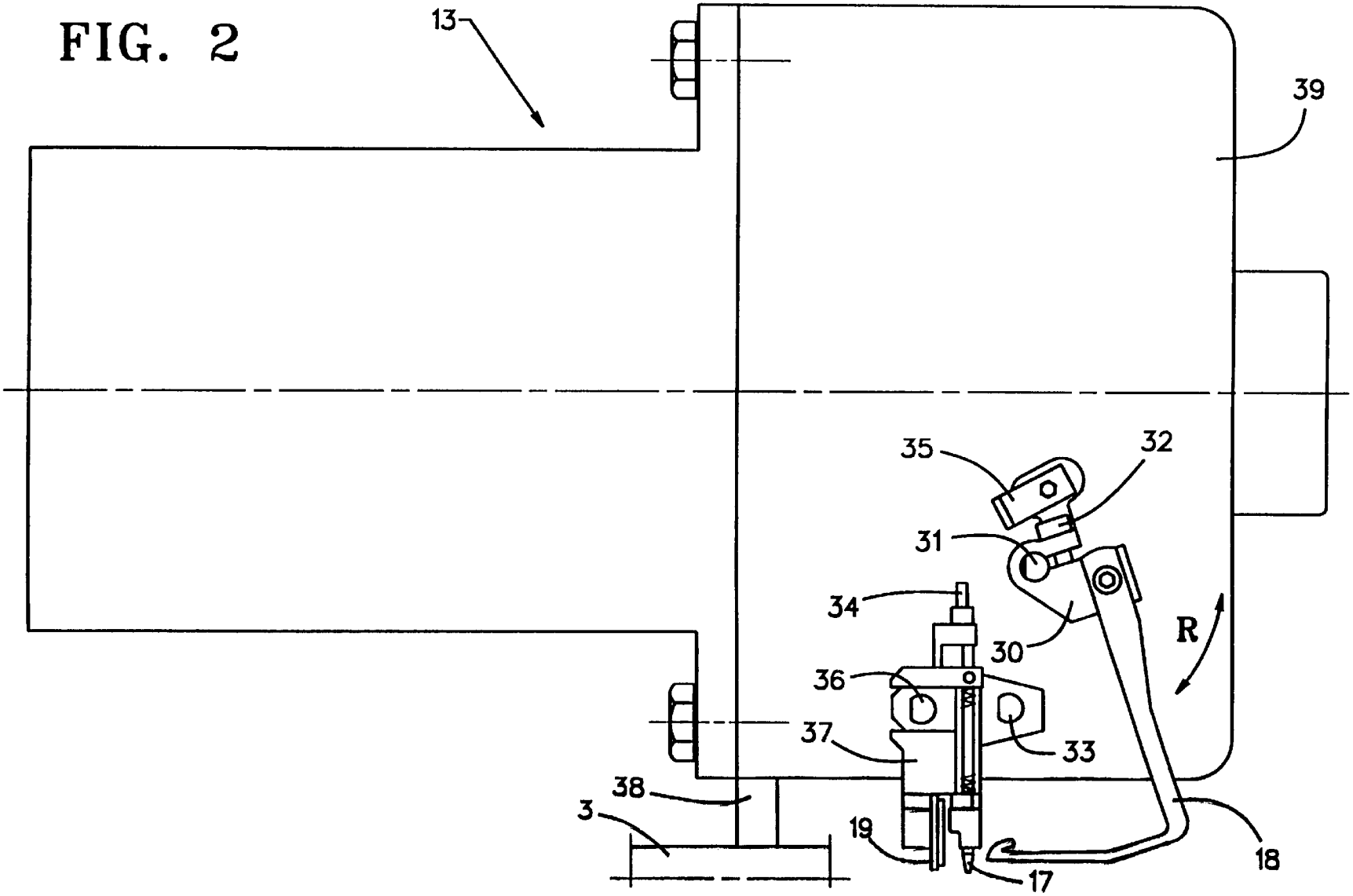
FIG. 2 is an elevation view in the direction of the arrow F2 in FIG. 1.

FIG. 2 shows the selvage insertion apparatus 13. The insertion arm 18 is provided with a clamp 30 affixed by a screw 32 on its drive bar 31. The insertion arm 18 is displaceable by the drive bar 31 in the axial direction of this rod and can be rotated in the direction R when the drive bar 31 is rotated. The thread clamp 17 is displaceable by a drive bar 33 in the axial direction of this bar. The thread clamp 17 furthermore is provided with a pushbar 34 so that it can open the clamp, this pushbar 34, in turn, being activated by a catch 35 of the clamp 30. The filling thread scissors 19 are mounted on a drive bar 36 and the two can be displaced in the bar's axial direction and, when moving toward the reed 5, this motion is converted by device 37 (indicated only in schematic manner) into a cutting motion of the blades of the filling thread scissors 19. The device opening the filling thread clamp 17 and actuating the filling thread scissors 19 are well known in the art and therefore are not discussed further herein. The selvage insertion apparatus 13 is affixed by a spacer 38 to the crossbar 3.

The drive bars 31, 33, 36 each are guided in a sliding bearing (not shown) mounted in the front part 39 of the housing of the selvage insertion apparatus 13 in such manner that they all can be axially displaced. The drive bars 33 and 36 are provided with axial bevels the shape of which is assumed by the sliding bearings. This feature prevents the drive bars 33, 36 from rotating. The sliding bearing for the drive bar 31 includes a cylindrical inner contour to allow rotation of the drive bar 31.

Figure 3:
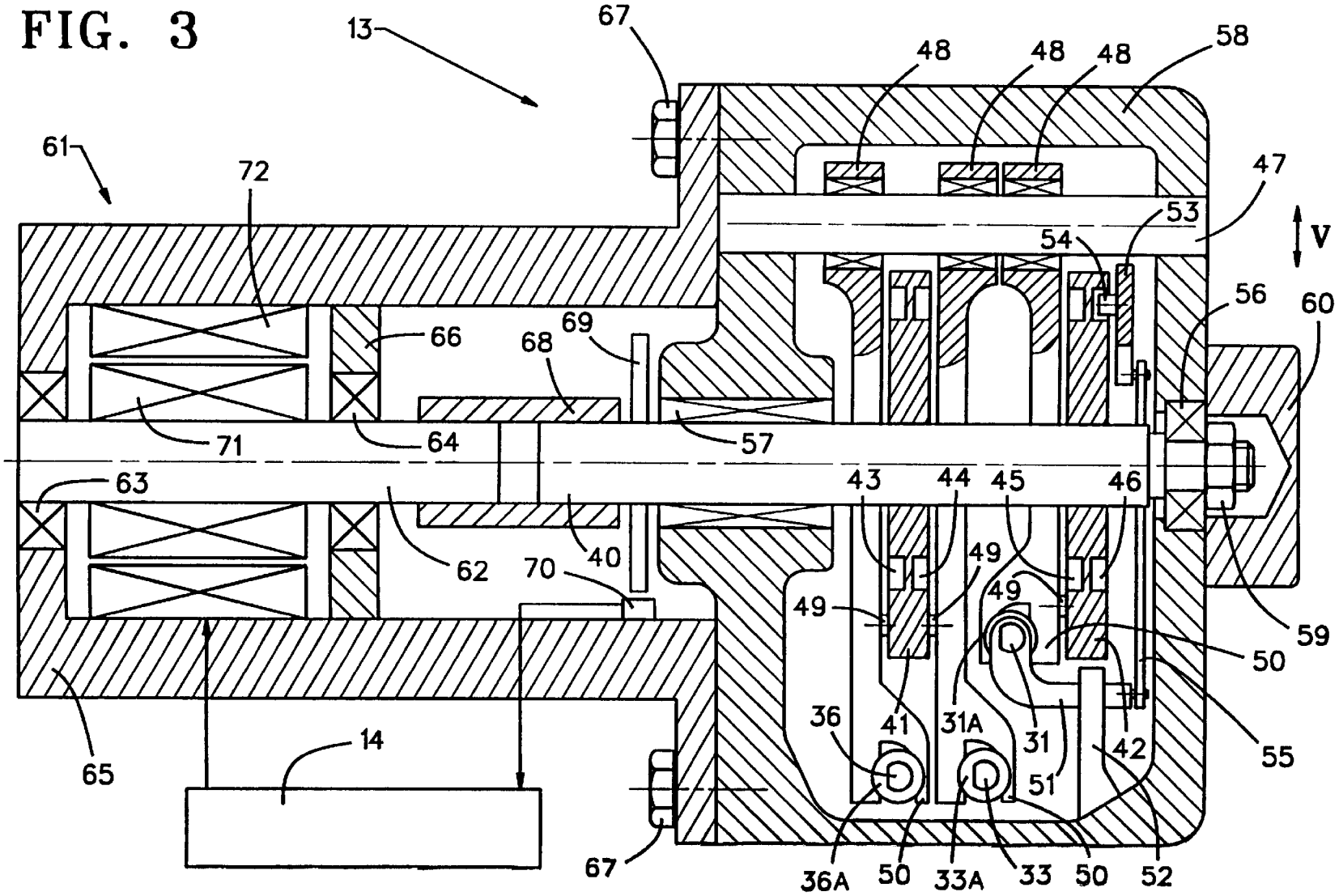
FIG. 3 is a partial section view along line III—III of FIG. 1.

As shown by FIG. 3, the selvage insertion apparatus 13 includes a common drive shaft 40 to power the drive bar 33 of the thread clamp 17, the drive bar 31 of the insertion arm 18 and the drive bar 36 of the filling thread scissors 19. The drive shaft 40 drives cam disks 41, 42 mounted fixedly in axially spaced relationship on this shaft 40 and provided with cam forms 43, 44 and 45, 46. The selvage insertion apparatus 13 further comprises a pivot device 47 on which are pivotably mounted three levers 48. Each lever 48 is provided with a stud 49 and a forked end 50. The stud 49 of the first lever 48 is guided on cam form 43. The forked end 50 of this first lever 48 engages between two radial shoulders 36A of the drive bar 36. The lever 48 is rotated about the pivot 47 by a rotation of the drive shaft 40 and through the stud 49, and as a result the drive bar 36 is axially displaced by the forked end 50 engaged between the shoulders 36A. The drive bars 31 and 33 are similarly axially displaced by the drive shaft 40 and by the levers 48 each provided with a stud 49 and a forked end 50. The drive bar 31 includes two radial shoulders 31A and the drive bar 33, and two shoulders 33A that are engaged in each case between forked ends 50 of the respective levers 48.

The drive bar 31 includes a lever 51 affixed in the axial direction of the drive bar 31 by a support 52. The drive bar 31 can be axially displaced within the lever 51, however it is affixed in the circumferential direction. Another lever 53 is mounted inside the selvage insertion apparatus 13 and is rotatable about a shaft (not shown) and is provided with a stud 54 entering the cam form 46 of cam disk 42. As the drive shaft 40 rotates, the lever 53 is reciprocated along the direction V. The lever 53 and the lever 51 of the drive bar 31 are joined to each other by a connecting rod 55 and each by a swivel joint. Motion of the lever 53 in the direction V therefore will be converted into rotational motion for the drive bar 31 in the direction R (FIG. 2).

Rotation of the drive shaft 40 entails, therefore, linear motions of the filling thread clamp 17, the insertion arm 18 and the filling thread scissors 19, with rotation furthermore being superposed on the insertion arm 18. The shapes and dimensions of the cam forms 43 through 46, of the levers 48, 51, 53 and of the connecting rod 55 are selected in such manner that they will implement the required motions. Because the motions of the filling thread clamp 17, the insertion arm 18 and the filling thread scissors 19 can be implemented by mechanical connections to the drive shaft 40, they are mutually and exactly synchronized and they will advantageously remain synchronized when the selvage insertion apparatus 13 is operational. Operation of the filling thread clamp 17, the filling thread scissors 19 and the insertion arm 18 from one common drive shaft 40 in turn powered by only one drive motor 61 offers the advantage that the internal synchronization of the filling thread clamp 17, filling thread scissors 19 and insertion arm 18 is unaffected by the control operation of the drive motor 61, and as a result the requirements for controlling the drive motor 61 are fewer than when all components are driven by their own drive motors and must be controlled accordingly.

The drive shaft 40 of the selvage insertion apparatus 13 rests on bearings 56, 57 in the housing 58. To axially affix the drive shaft 40, the bearing 56 is positioned by a nut 59 screwed onto the drive shaft 40. The bearing 56 in turn is positioned in the housing 58 by a fastener 60. The bearing 57 illustratively is positioned by a press-fit in the housing 58.

The selvage insertion apparatus 13 includes a drive motor 61 controlled by the control system 14. The motor shaft 62 rests in bearings 63 and 64. The bearing 63 in turn rests in the motor housing 65 and the bearing 64 is mounted in a partition 66. The motor housing 65 is affixed by screws 67 to the housing 58. The motor shaft 62 is linked by a flexible coupling 68 to the drive shaft 40. This flexible coupling 68 compensates against alignment deviations between the motor shaft 62 and the drive shaft 40 while precluding relative circumferential motion. An encoding disk 69 is mounted on the drive shaft 40 and cooperates with a sensor 70 mounted inside the housing 65 that transmits signals which are a function of the angular position of the encoding disk 69, and hence of the drive shaft 40, to the control system 14. A rotor 71 of the electric motor is mounted on the motor shaft 62 and cooperates with a drive motor stator 72 inside the motor housing 65.

In regard to embodiments that are modifications over that of FIG. 3, the motor shaft 62 of the drive motor 61 and the drive shaft 40 of the selvage insertion apparatus 13 are not configured in axial sequence. In this latter case they are connected by transmission elements. The motor shaft and the drive shaft 40 can be configured to run parallel to each other or illustratively also at an angle of 90°. In the former case a gear or belt transmission may be used, whereas in the latter a bevel-gear transmission may be used.

Figure 4:
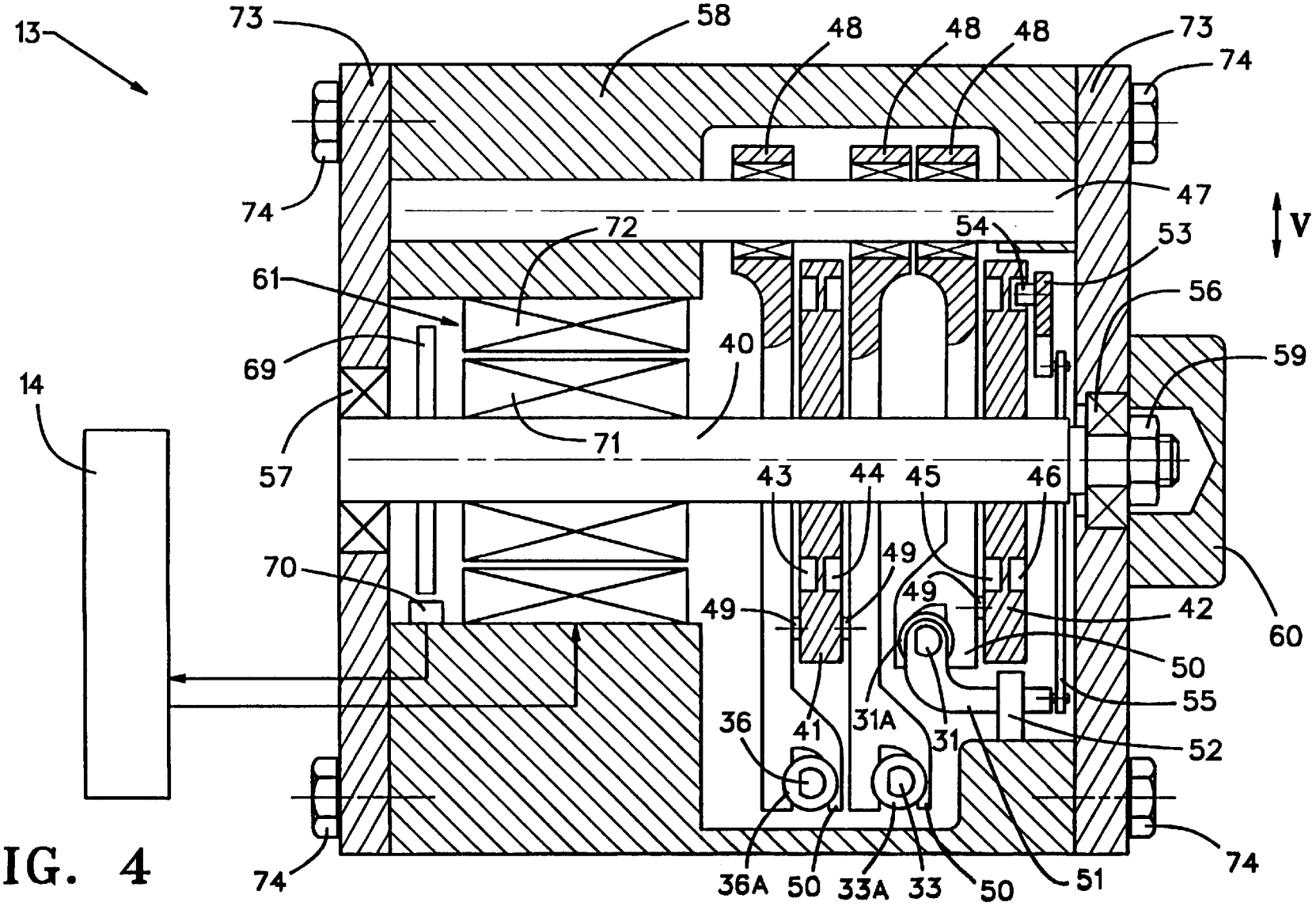
FIG. 4 is a partial section view along FIG. 3 of a modified embodiment of selvage insertion apparatus.

In the embodiment of FIG. 4, the drive motor 61 and the selvage insertion apparatus 13 are one sub-assembly with only one housing. The components corresponding to the embodiment of FIG. 3 are denoted by the same references and will not be discussed further hereafter. The rotor 71 is mounted on the drive shaft 40 which thereby becomes the motor shaft. The associated stator 72 is received in the housing 58 of the selvage insertion apparatus 13. This drive motor 61 also is controlled from the control system 14. To assure problem-free assembly, the bearings 56, 57 for the drive shaft 40, which also is a motor shaft, are each mounted in a flange 73 affixed by screws 74 to the housing 58. The embodiment of FIG. 4 offers the advantage compared to the embodiment of FIG. 3 that this sub-assembly is more compact and thus demands less space inside the weaving machine.

Operation of the selvage insertion apparatus 13 will now be described. This description appropriately also applies to operating the selvage insertion devices 11, 12.

The sensor 21 cooperating with the encoding disk 20 transmits signals which are a function of the angular position of the weaving machine's main shaft 8 relative to the control system 14. This position also represents the position of the batten 4 and of the positions of the shed-forming devices (not further discussed herein) and hence of the sheds formed by the warp threads 26. The position of the drive shaft 40 of the selvage insertion apparatus 13 is determined by the control system 14 from the signals derived from the sensor 70 which senses the rotation of the encoding disk 69 and transmits the information to the control system 14.

The control system 14 controls the speed-controlled drive motor 61 of the selvage insertion apparatus 13. Speed control can be implemented in a known manner using frequency control or phase-angle control. The signals from the sensor 70 may be used in this process for feedback by the control system 14.

Figure 5:
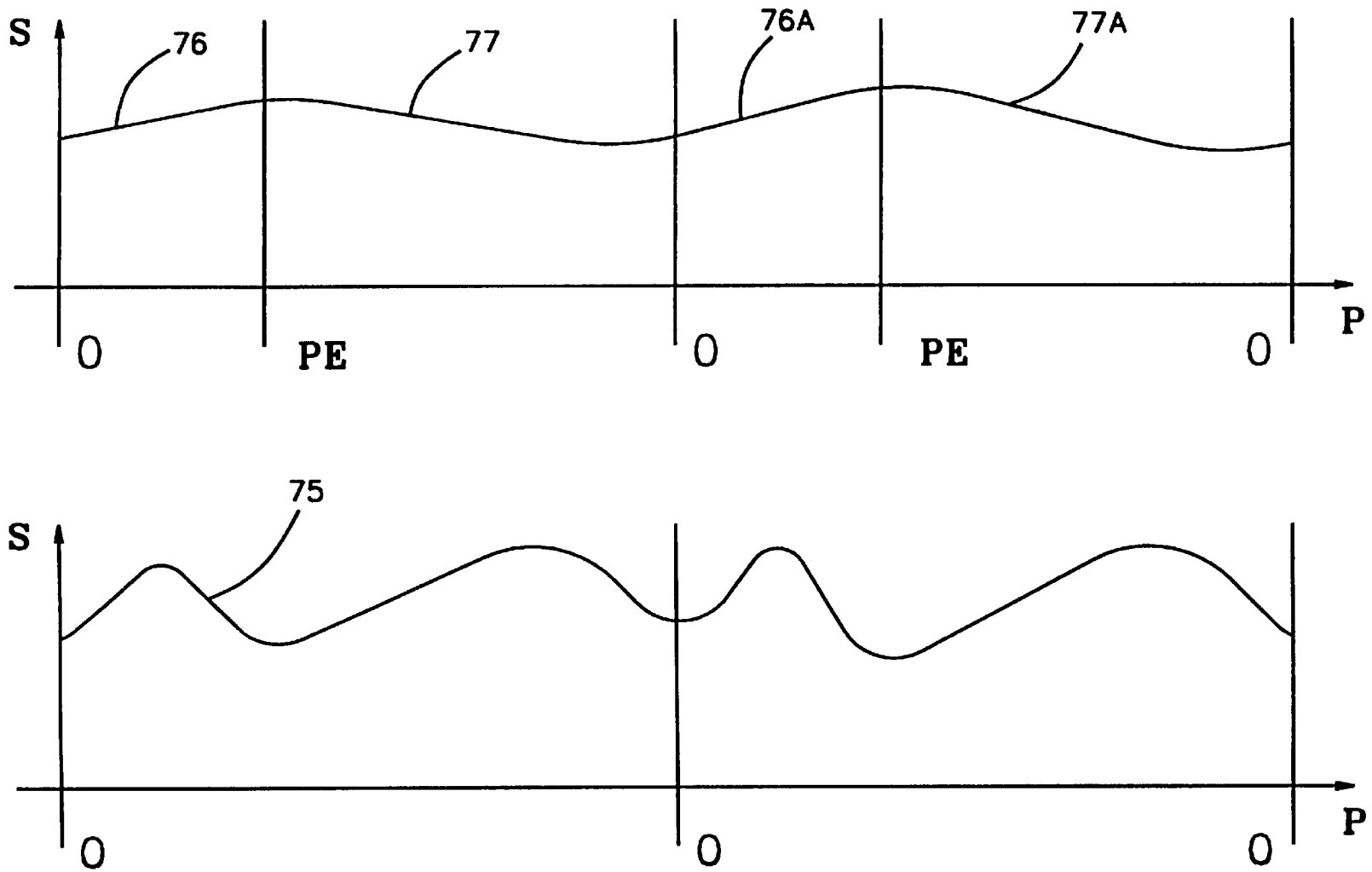
FIG. 5 is a plot showing the speed of the weaving machine's main shaft and the speed of the drive shaft of the selvage insertion apparatus.

The invention not only synchronizes the speed of the drive motor 61 with that of the weaving machine's main shaft 8, but furthermore the speed of the drive motor 61 is controlled in a desired manner when the filling threads are inserted. FIG. 5 shows such operation. The curve 75 shows the observed speed of the weaving machine's main shaft 8. Curves 76, 77 and 76A, 77A show the controlled speed of the drive shaft 40. The curves show two weaving cycles. The curves 76 and 76A depend on the selected type of inserted filling thread and/or weave pattern, that is, the pattern at which the inserted filling thread is interlaced between the warp threads 26. As regards filling threads of low strength, the curves 76 and 76A are selected in such manner that the insertion arm 18 will not apply large or strongly changing forces to the filling thread. As regards weaves with only few warp threads 26 in the upper shed, the curves 76 and 76A illustratively are selected in such a way that the insertion arm 18 dwells longer between the sets of warp threads than for weaves with a large number of warp threads 26 in the upper shed.

The initial position O coincides with the position at which the selvage insertion apparatus 13 or at least its insertion arm 18 as yet has not been applied to the weft. At this stage the weaving machine's main shaft 8 is in a specifically defined reference position, for instance 100° behind the stop position of the reed 5. The speed of the drive motor 61 is controlled in such manner that the speed of at least the insertion arm 18 shall follow a prescribed function during filling thread insertion.

For this purpose the speed of the drive motor 61 is controlled according to a predetermined function while taking into account the mechanical transmission between the drive shaft 40 and the drive bar 31. Such a function is shown in FIG. 5 by the curve 76. An appropriate function is stored in a memory in the control system 14 for every kind of insertable filling thread. From the initial position O, the speed of the drive motor 61 is controlled by a program retrieved from the control system 14 and independently of the speed of the weaving machine's main shaft 8. A check is carried out using the signals from the sensor 70 whether the drive motor 61 is in fact being controlled according to the speed-function of the curve 76. Where required, correction is introduced to match the speed of drive motor 61 to this function. This speed control takes place at least over the time interval within which a filling thread is inserted by the insertion arm 18 into a subsequent shed, preferably over the full time interval during which the selvage insertion apparatus 13 acts on the filling thread. This control is applied between the initial position O and end position PE of the drive shaft 40 of the selvage insertion apparatus 13, for instance 120 to 180° later, at which time the selvage insertion apparatus 13 no longer acts on the filling thread. The function of the curve 76 may be selected in such manner that, by taking into account the mechanical transmission constraints, the speed of the insertion arm 18 shall be approximately constant or, if necessary, slightly higher. This procedure offers the advantage that the filling thread remains taut in the hook of the insertion arm 18 and the likelihood of the insertion arm 18 losing the filling thread will be reduced.

Even after the time when the drive shaft 40 has reached the end position PE, the speed of the drive shaft 40 is still being controlled by the drive motor 61 as a function of the position and speed of the weaving machine's main shaft 8. This function is predetermined in such a way that the drive shaft 40 again shall be in the next initial position O when the main shaft 8 is at the next reference position. The expected time at which the main shaft 8 will reach the reference position is determined by the control system 14 as a function of the signals from the sensor 21 and taking into account further effects, for instance the weave pattern stored in the control system 14 and implemented by the weaving machine. The speed of the drive motor 61 is controlled in such a way that the drive shaft 40 shall be in the initial position O at the predetermined time. In this process the speed of the drive motor 61 is controlled in such manner that the speed between the previous end position PE and the ensuing initial position O shall be approximately constant. The speed at the previous end position PE and the next initial position O is determined by the function stored in the control system 14. The function of the curve 77 must be continuous with those of the curves 76 and 76A.

The irregularity of the speed of the main shaft 8 shown by the curve 75 does not affect the speed function of the drive shaft 40 so long as the selvage insertion apparatus 13 cooperates with the filling thread. The drive shaft 40 is controlled by a predetermined speed function stored in the control system 14. The effect of the irregular speed of the weaving machine's main shaft 8 is cancelled by the control system 14 according to the curves 77, 77A by appropriately powering the drive motor 61 while the selvage insertion apparatus 13 is not cooperating with a filling thread. The speed thus provided does not affect selvage formation.

If the speed of the drive motor 61 were to be wholly synchronized with the speed of the main shaft 8, then the speed of the selvage insertion apparatus 13 would vary when cooperating with the filling thread. The latter speed no longer would be optimal to insert a filling thread. Cancellation of speed changes between the previous end position and the next initial position O of the drive shaft 40 is easily implemented and raises no problems because it does not affect the action of the selvage insertion apparatus 13 on the filling thread.

The selvage insertion apparatus 13 is independently controlled by the weaving machine's main shaft 8 when a filling thread is inserted and there is a chance that parts of the selvage insertion apparatus 13, for instance the filling thread clamp 17, the insertion arm 18 or the filling thread scissors 19 will make contact with the weaving machine's reed 5. Such contact might materialize if the synchronization differential between the drive shaft 40 of the selvage insertion apparatus 13 and the weaving machine's main shaft 8 were to exceed a given threshold. To avoid this problem, the control system 14 can control the drive motor 61 of the selvage insertion apparatus 13 as a function of the position of the reed 5 which in turn is determined by the position of the main shaft 8 in such a manner as to preclude the filling thread clamp 17, the insertion arm 18 or the filling thread scissors 19 from making contact with the weaving machine's reed 5. This allows for controlling the selvage insertion apparatus 13 in such a way by a program retrieved from the control system 14 that the insertion arm 18 will stay as long as possible between the warp threads for selvage formation without the risk of collisions in the event of variations in synchronization.

One procedure for such purpose determines the position of the reed 5, for instance by the sensor 21, and if thereupon it is found that the synchronization differential between the drive shaft 40 and the main shaft 8 is above a given threshold value, the sub-assembly is controlled in such manner as a function of the ascertained position and independently of the speed function 76, 76A of the drive motor 61 of the selvage insertion apparatus 13 that the filling thread clamp 17, the insertion arm 18 and the filling thread scissors 19 are precluded from coming into contact with the reed 5. A synchronization differential between the main shaft 8 and the drive shaft 40 is ascertained by comparing the signals from the sensors 21 and 70. Moreover the positions of the main shaft 8 and of the drive shaft 40 at which the above mentioned components of the selvage insertion apparatus 13 might touch the reed 5 are fed through a keyboard or in another electronic manner into the control system 14. If the control system 14 that controls the speed of drive motor 61 as shown in curves 76, 76A of FIG. 5 determines that there is danger of touching, namely that the possible positions of the main shaft 8 and drive shaft 40 are within the threshold values stored in the control system 14, the drive motor 61 will be controlled to eliminate the mutual synchronization differential. While such action may be disadvantageous for the insertion of filling threads, it nevertheless offers the advantage of preventing damage to the filling thread clamp 17, the insertion arm 18 and the filling thread scissors 19 and/or the reed 5. Not only would such damage shut down the weaving machine for some significant time, but the damaged components of the selvage insertion apparatus 13 or a damaged reed 5 would cause quality degradation to the fabric.

In a modified embodiment of the invention, the position of the reed 5 is determined not by using the sensor 21 but by using one or several proximity sensors 28. Each proximity sensor 28 transmits a signal of the position of the reed 5 to the control system 14. One or more such proximity sensor(s) 28 may also be used to determine a reference position of the reed 5, for instance, the beat-up position.

The selvage insertion apparatus 11 comprising only one filling thread clamp 17 and one insertion arm 18 can be designed similarly to the above discussed selvage insertion apparatus 13. However the drive bar 36 and the associated lever 48 and the cam shape 43 may be eliminated. The selvage insertion apparatus 12 comprising two filling thread clamps 17, two insertion arms 18 and one filling thread scissors 19 can also be designed for the above selvage insertion apparatus 13. In this latter case, however, a second drive bar 33 and an associated lever 48 and an associated cam shape 44 as well as a second drive bar 31 with associated levers 51, 53 and support 52 as well as a connecting rod 55 and a cam shape 46 must be provided. Thereupon the control function and operation of the selvage insertion apparatus 11 and 12 correspond to that of the selvage insertion apparatus 13.

As regards a selvage insertion apparatus 12 located between two fabrics 22 and 23, the invention offers the further advantage that, upon determination of a defective filling thread, the drive motor 61 of this selvage insertion apparatus 12 is controlled in such manner that the filling thread scissors 19 of this apparatus 12 will not cut the defective filling thread. This feature can be implemented for instance by not energizing the drive motor 61 of the apparatus 12 when a filling thread detector 75 detects an improperly inserted filling thread and then informs the control system 14 of it. Because a defective filling thread is always being detected before the filling thread is beat-up, and because the selvage insertion apparatus 12 usually acts only after beat-up of such a filling thread, cutting this filling thread can be prevented merely by timely interrupting the power to the drive motor 61. The end of the defectively inserted filling thread is located behind the selvage insertion apparatus 12 and can be removed by the method disclosed in U.S. Pat. No. 4,898,214.

If a defectively inserted filling thread is already locked up and must be removed, so-called pickfinding motions are carried out whereby the warp thread interlacings are undone by the shed-forming elements, with the batten 5 being shut down at a predetermined position. The drive motor 61 of the selvage insertion devices 11, 12, 13 is not controlled during this motion and therefore the devices 11, 12, 13 are not activated during the pickfinding motion. This feature offers the advantage that the batten 5 and the shed-forming devices can be moved both forward and backward into given batten positions without being affected by the selvage insertion apparatus 11, 12, 13, from which the so-called pickfinding motion then can be initiated.

The speed functions 76, 76A of the drive shaft 40 can be fed through an input device (not shown) or in any other electronic way into the control system 14. Furthermore, the initial and final positions can be fed through an appropriate input unit into the control system 14. Obviously the input values can be changed any time to implement optimal insertion of filling threads.

The invention is not restricted to the illustrative embodiments shown and discussed in relation to the drawings. Other configurations and dimensions are quite feasible. The scope of protection is defined solely by the attached claims.

What is claimed is:

1. A weaving machine selvage insertion apparatus (11, 12, 13) comprising:

at least one insertion arm (18);

at least one filling thread clamp (17);

a common drive shaft (40) drivingly connected to both the at least one insertion arm (18) and the at least one filling thread clamp (17), the drive shaft (40) configured to control a filling thread; and a drive motor (61) controlled by a programmable control system (14), wherein the drive shaft (40) is powered by the drive motor (61).

2. The weaving machine selvage insertion apparatus (11, 12, 13) as claimed in claim 1, including at least one sensing device (69, 70), wherein the at least one sensing device (69, 70) is arranged to transmit drive shaft position feedback signals to the control system (14), said control system arranged to process the drive shaft position feedback signals for determining the position of the drive shaft (40).

3. The weaving machine selvage insertion apparatus (11, 12, 13) as claimed in claim 2, wherein the control system (14) includes one or more stored programs that controls the speed of the drive motor (61) during the insertion of the filling thread.

4. The weaving machine selvage insertion apparatus (11, 12, 13) as claimed in claim 1, wherein the control system (14) includes one or more stored programs that control the speed of the drive motor (61) during the insertion of the filling thread.

5. The weaving machine selvage insertion apparatus (11, 12, 13) as claimed in claim 1, wherein the control system (14) includes at least one stored program that is customized for different kinds of filling threads and/or different weave patterns.

6. The weaving machine selvage insertion apparatus (11, 12, 13) as claimed in claim 1, including at least one filling thread detector (75) that detects defective filling threads, wherein the at least one filling thread detector (75) is in communication with the control system (14) such that when a defective filling thread is detected by the at least one filling thread detector (75) the control system (14) is configured to interrupt the operation of the drive motor (61).

7. The weaving machine selvage insertion apparatus (11, 12, 13) as claimed in claim 1, wherein the drive motor (61) includes a shaft that is configured as the common drive shaft (40).

8. A weaving machine including a selvage insertion apparatus (11, 12, 13), wherein said selvage insertion apparatus comprises:

at least one insertion arm (18);

at least one filling thread clamp (17);

a common drive shaft (40) drivingly connected to both the at least one insertion arm (18) and the at least one filling thread clamp (17), the drive shaft (40) configured to control a filling thread; and a drive motor (61) controlled by a programmable control system (14), wherein the drive shaft (40) is powered by the drive motor (61).

9. The weaving machine as claimed in claim 8, wherein the weaving machine includes a main shaft (8) and at least one detecting device (20, 21, 28), and the at least one detecting device (20, 21, 28) is configured to detect the position of the main shaft (8) of the weaving machine.

10. The weaving machine as claimed in claim 9, further comprising at least one sensing device (69, 70), the at least one sensing device (69, 70) is arranged to transmit drive shaft position feedback signals to the control system (14), and said control system is arranged to process the drive shaft position feedback signals for determining the position of the drive shaft (40).

11. The weaving machine as claimed in claim 9, wherein the weaving machine includes a reed (5), the control system (14) is configured to compare the motion of the reed (5) of the weaving machine with the motion of the drive shaft (40) such that prior to any potential collision between the reed (5) and parts of the selvage insertion apparatus, the control system (14) changes operational mode of the drive motor (61) to prevent such collision.

12. The weaving machine as claimed in claim 11, wherein the detecting device (28) is configured to detect positions of the reed (5) of the weaving machine and transmit a reed position signal to the control system (14), and said control system arranged to receive and process said reed position signal to determine the reed position.

13. The weaving machine as claimed in claim 9 wherein the weaving machine further comprises a filling thread scissors having a drive, and the common drive shaft (40) is mechanically linked to the drive of the filling thread scissors (19).

14. The weaving machine as claimed in claim 8, wherein the weaving machine includes a reed (5), the control system (14) is configured to compare the motion of the reed (5) of the weaving machine with the motion of the drive shaft (40) such that prior to any potential collision between the reed (5) and parts of the selvage insertion apparatus, the control system (14) changes operational mode of the drive motor (61) to prevent such collision.

15. The weaving machine as claimed in claim 8, wherein the weaving machine includes a reed (5) and at least one detecting device (28), the detecting device (28) is configured to detect positions of the reed (5) of the weaving machine and transmit a reed position signal to the control system (14), and said control system is arranged to receive and process said reed position signal to determine the reed position.

16. The weaving machine as claimed in claim 8, wherein the weaving machine further comprises a filling thread scissors having a drive, and the common drive shaft (40) is mechanically linked to the drive of the filling thread scissors (19).

* * * * *